US005570835A

United States Patent [19]

Sung et al.

[11] Patent Number: 5,570,835

[45] Date of Patent: Nov. 5, 1996

[54] SELF-REPLY ENVELOPE

[76] Inventors: Foyer Sung; Niema Sung; Gina Sung; Anne Sung; Lina Sung, all of 36 Hewitt Ave., Staten Island, N.Y. 10301

[21] Appl. No.: 372,012

[22] Filed: Jan. 12, 1995

[51] Int. Cl.[6] ..... B65D 27/06

[52] U.S. Cl. ..... 229/301; 229/313

[58] Field of Search ..... 229/301, 302, 229/303, 304, 305, 313, 316, 300

[56] References Cited

U.S. PATENT DOCUMENTS

| | | | |
|---|---|---|---|
| 107,166 | 9/1870 | Davis . | |
| 1,091,172 | 3/1914 | Thayer . | |
| 1,173,869 | 2/1916 | Rougeux . | |
| 2,686,005 | 8/1954 | Hyman | 229/305 |
| 2,695,130 | 11/1954 | Covan | 229/305 |
| 3,863,836 | 2/1975 | Austin . | |
| 3,937,492 | 2/1976 | Biron | 229/304 X |
| 4,445,635 | 5/1984 | Barr | 229/302 |
| 4,706,877 | 11/1987 | Jenkins . | |
| 5,238,182 | 8/1993 | Loch . | |

FOREIGN PATENT DOCUMENTS

| | | | |
|---|---|---|---|
| 9043 | 4/1913 | United Kingdom | 229/301 |
| 994 | 1/1914 | United Kingdom | 229/303 |
| 1001687 | 8/1965 | United Kingdom | 229/313 |

*Primary Examiner*—Jes F. Pascua
*Attorney, Agent, or Firm*—Goldstein & Associates

[57] ABSTRACT

The invention is a self-reply envelope, having a front panel and a rear panel, creating a pocket therebetween. The front panel has recipient indicia and sender address indicia. The front panel has return mail indicia and a sender arrow adjacent to the return mail indicia that refers to the sender indicia. The rear panel has a main flap that is sealable to the front panel. The rear panel has an outer flap, an inner flap, and an opening tab between the outer flap and inner flap. The main flap covers the return mail indicia. The opening tab is removable to open the envelope, and to reveal the return mail indicia. The envelope is resealable by the recipient without obscuring the return mail indicia so that the envelope may be returned to the sender by re-mailing the envelope.

5 Claims, 3 Drawing Sheets

SELF-REPLY ENVELOPE

BACKGROUND OF THE INVENTION

The invention relates to a self-reply envelope. More particularly, the invention relates to a two-way mailer envelope which allows a single envelope to be utilized for two correspondences, without the need for re-labeling or re-addressing said letter envelope.

Utility companies and other service providers mail and receive a great deal of correspondence with their customers. Normally, a bill is mailed by the utility company/sender in an envelope, which contains another envelope for the customer/recipient to use when they return payment to the sender. Clearly, the use of two envelopes in inefficient, and is not ecologically sound.

In the prior art, it is well known to provide one envelope which can be utilized in two mailings. Usually, various parts of the envelope are folded upon one another and glued together to form an open pocket for reception of a letter. Most two-way mailers also utilize a hinged flap, which is folded over and hides a pre-printed return address on the envelope. Upon receipt of the letter by the initial recipient, the hinged flap must be unfolded so as to reveal the pre-printed return address. Problems inherent in this manner of using two-way mailers are that the folding and unfolding of the hinged flap can interfere with the postal system's processing of the envelope. Gum residue and paper fragments which may be left behind on the pre-printed return address once the hinged flap has been unfolded can interfere with optical character recognition methods employed by the postal service.

U.S. Pat. No. 5,238,182 to Loch discloses a complex mailer employing two separate sheets in its production, and also having die cut windows of glassine. This mailer also employs a method of peeling back separate plies of material from each sheet in order to utilize the two-way function of the mailer.

U.S. Pat. No. 4,706,877 to Jenkins discloses a two-way mailer which requires a recipient to sever a marginal label portion of the envelope, and then re-apply the peeled-off label to the upper left hand corner of the envelope such that it then constitutes the recipient's return address. In the event that this label does not remain affixed to the mailer, important mail may be incapable of being returned to sender in the event that it is unable to reach it's intended location.

While these units may be suitable for the particular purpose employed, or for general use, they would not be as suitable for the purposes of the present invention as disclosed hereafter.

SUMMARY OF THE INVENTION

It is an object of the invention to produce a self-reply envelope to be utilized for two-way mailings.

It is another object of the invention to produce a two-way mailer which is simple in design and use, yet works efficiently, easily and consistently.

It is a further object of the invention to allow a sender of mail to correspond with a recipient. Once the correspondence is received by the recipient, such recipient simply removes the correspondence from the two-way mailer by pulling an opening tab, re-inserts an appropriate response correspondence, re-seals the main flap, and mails the envelope back to the original sender. Upon mailing the envelope back to the original sender, the recipient need not address the envelope, attempt to reveal any address windows or place any special labels anywhere on the face of the envelope. The recipient need only pull the opening tab to remove the correspondence contained within the envelope, an act which has the effect of revealing return mail indicia refers to the sender, and thus directs the postal system to send the envelope to the address of the original sender.

The invention is a self-reply envelope, having a front panel and a rear panel, creating a pocket therebetween. The front panel has recipient indicia and sender address indicia. The front panel has return mail indicia and a sender arrow adjacent to the return mail indicia that refers to the sender indicia. The rear panel has a main flap that is sealable to the front panel. The rear panel has an outer flap, an inner flap, and an opening tab between the outer flap and inner flap. The main flap covers the return mail indicia. The opening tab is removable to open the envelope, and to reveal the return mail indicia. The envelope is resealable by the recipient without obscuring the return mail indicia so that the envelope may be returned to the sender by re-mailing the envelope.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
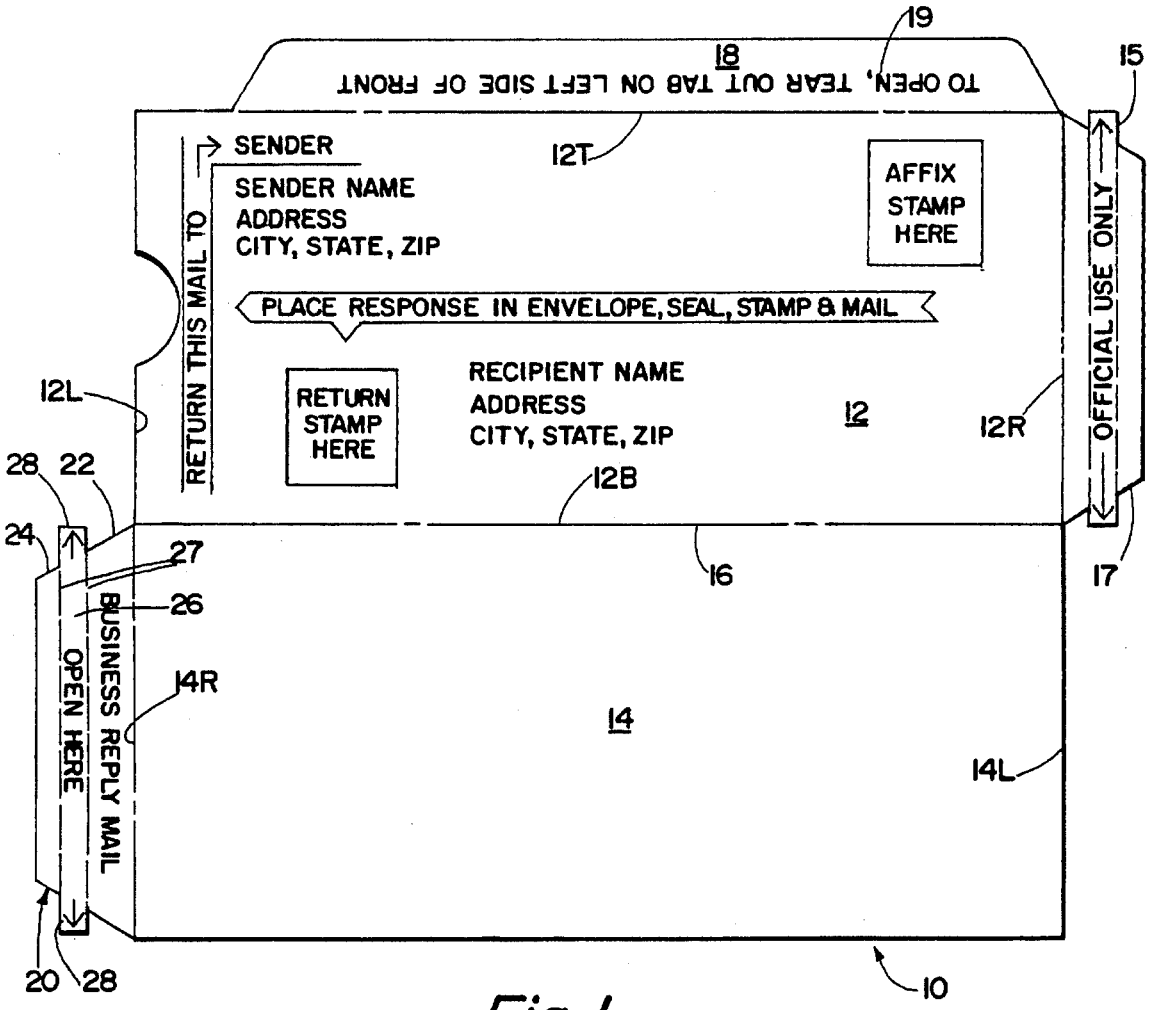
FIG. 1 is an exploded view of the instant invention, ready to be folded into an envelope.

FIG. 1 illustrates a self-reply envelope 10, in an exploded view which illustrates the envelope in a fully unfolded position. The envelope 10 comprises a front panel 12 and a rear panel 14 which comprise a single piece of material. The front panel 12 and rear panel 14 are rectangular, and are substantially the same size. The front panel 12 has a front panel top 12T and a front panel bottom 12B. The rear panel 14 is joined to the front panel 12 with a main fold 16 at the front panel bottom 12B.

The front panel 12 has a front panel left 12L and a front panel right 12R. The rear panel 14 has a rear panel left 14L and a rear panel right 14R. An official flap 17 extends from the front panel 12 along front panel right 12R, the official flap 17 has an official tab 15 for opening the official flap 17 the official tab 15 having official tab indicia which indicates to the user that the official flap 17 is for official use only. A top flap 18 is connected to the front panel 12 along the front panel top 12T. The top flap 18 has warning indicia 19, indicating that the top flap 18 is not to be opened, and indicating the correct way to open the envelope. In addition, the front panel 12 has an upper left, lower left, upper right, and lower right.

The rear panel has a main flap 20 which is attached along and extends from the rear panel right 12R. The main flap 20 has an inner flap 22 which borders the rear panel right 14R, an outer flap 24 opposite the inner flap 22, and an opening tab 26 between the outer flap 24 and inner flap 22. The opening tab 26 has a pair of perforated edges 27 connecting the opening tab 26 with the outer flap 24 and inner flap 22. The opening tab 26 has two handles 28 at opposite ends of the opening tab 26.

Figure 2:
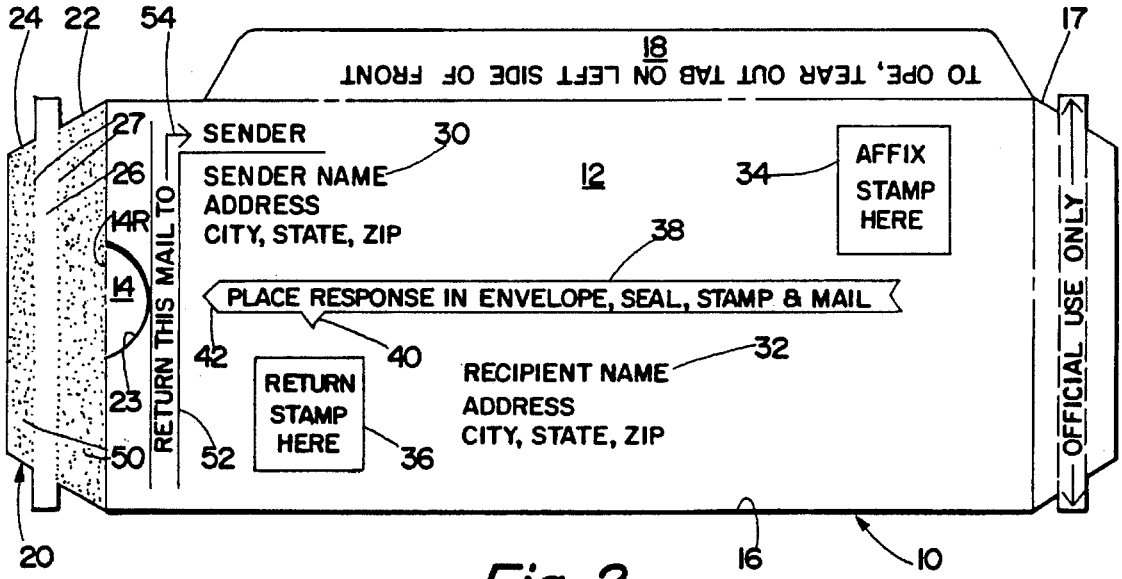
FIG. 2 is a front view of the envelope, partially assembled.

Referring now to FIG. 2, the envelope 10 has been folded along the main fold 16, bringing the rear panel 14 directly behind the front panel 12, creating a pocket between the front panel 12 and rear panel 14. The front panel 12 has a finger indent 23 at the front panel left 12L, to facilitate the insertion and removal of correspondence to and from the envelope 10.

The front panel 12 has sender address indicia 30, indicating the sender's name and address. The front panel 12 also has recipient indicia 32, indicating the recipient's name and address. The sender address indicia 30 and recipient indicia 32 are in standard upper-left and lower-right positions on the front panel 12, respectively. In addition standard stamp indicia 34 is located upper-right on the front panel 12. However, return stamp indicia 36 is also present, and is located in the lower left position of the front panel 12, almost directly below the sender address indicia 30. Instructional indicia 38 extends beneath the sender address indicia 30 and above the recipient indicia 32, extending parallel to the front panel top 12T and front panel bottom 12B, midway therebetween. The instructional indicia 38 has a first instructional arrow 40, which points toward the return stamp indicia 36, and a second instructional arrow 42, which points toward the front panel left 12L.

The main flap has gummed portions 50 on the outer flap 24 and inner flap 22. The gummed portion 50 on the outer flap 24 extends roughly up to the perforated edge 27 connecting the opening tab 26 with the outer flap 24. The gummed portion 50 on the inner flap 24 extends between the rear panel right 14R and the perforated edge 27 connecting the opening tab 26 with the inner flap 22.

The inner flap 22 has an inner flap width, which is the distance between the rear panel right 14R and the perforated edge 27 connecting the opening tab 26 with the inner flap 22. The opening tab 26 has an opening tab width, which is the distance between the perforated edges 27.

The front panel 12 has return mail indicia 52, which extends between the front panel bottom 12B and front panel top 12T. The return mail indicia 52 is located a distance from the front panel left 12L corresponding to the inner flap width. The return mail indicia 52 has a return mail width which is substantially equal to the opening tab width. The return mail indicia 52 generally recites "return this mail to" or "return envelope to", and refers to the sender address indicia 30 by means of a sender arrow 54 that is adjacent to the return mail indicia 52.

To complete assembly of the envelope 10, correspondence such as a bill, is placed between the front panel 12 and rear panel 14. The top flap 18 is sealed to the rear panel 14, and the official panel 17 is sealed to the rear panel left 14L. Finally, the main flap 20 is secured to the front panel 12 by affixing the gummed portion 50 on the outer flap 24 to the front panel 12. The result is the envelope shown in FIG. 3.

Figure 3:
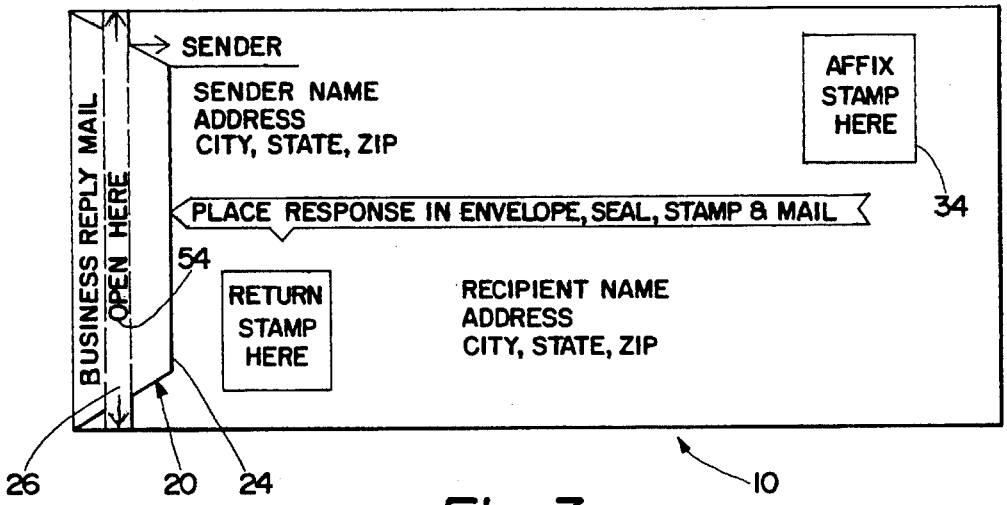
FIG. 3 is a front view of the envelope. The envelope has been sealed and is ready to be sent to a recipient.

In FIG. 3, the envelope 10 has been prepared to be sent to the recipient. The main flap 20 covers the return mail indicia 52, the gummed portion on the outer flap 24 has been affixed to the front panel 12. The opening tab 26 has opening tab indicia 54, which recites "open here". Postage is affixed at the standard stamp indicia 34. The envelope 10 is then ready to send to the recipient. With the return mail indicia 52 covered, the post office is directed to deliver the mail to the recipient indicated by the recipient indicia 32.

Figures 4, 5, 6:
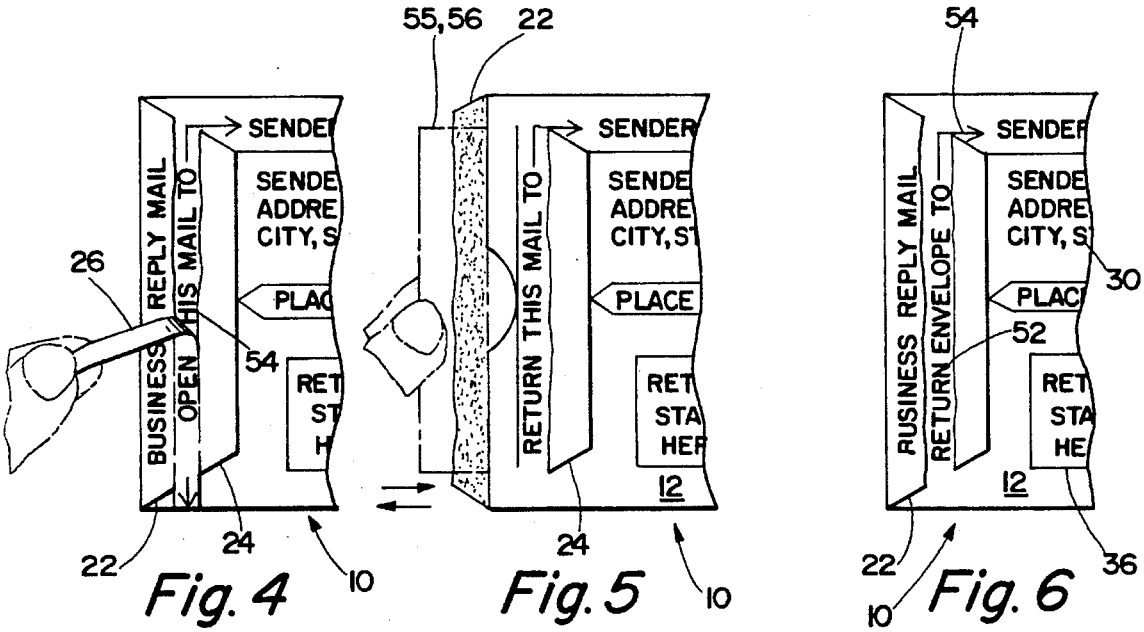
FIG. 4 is a front view of the envelope. The opening tab is being pulled by the recipient to open the envelope.
FIG. 5 is a front view of the envelope in an opened position, with the recipient removing a bill and inserting payment.
FIG. 6 is a front view of the envelope, which has been sealed by the recipient, and which now indicates that the envelope is to be returned to the sender.

In FIG. 4, the envelope 10 has been received by the recipient, who has read the opening tab indicia 54 and thus, is peeling the opening tab 26. As the opening tab 26 is peeled, the return mail indicia 52 is revealed which is situated directly beneath the opening tab 26, and the inner flap 22 is freed from the outer flap 24, which is affixed to the envelope.

In FIG. 5, the opening tab 26 has been completely removed, freeing the inner flap 22 from the front panel 12 to open the envelope 10, and revealing the return mail indicia 52 which was directly beneath the opening tab 26. The envelope 10 is now open, and the recipient is able to remove the correspondence 55, and replace it with response correspondence 56 such as payment. Note that the outer flap 24 has remained affixed to the front panel 12.

In FIG. 6, the envelope 10 has been re-sealed by the recipient for return to the sender. Proper postage should be affixed to the return stamp indicia 36. The gummed portion 50 of the inner flap 22 has affixed the inner flap 22 to the front panel 12, sealing the envelope 10. However, the return mail indicia 52 is not obscured upon resealing of the envelope. The return mail indicia 52 is displayed between the inner flap 22 and outer flap 24. The return mail indicia 52, in conjunction with the sender arrow 54 adjacent to the return mail indicia 52, instructs the post office to deliver the envelope 10 to the sender indicated by the sender address indicia 30.

Figure 7:
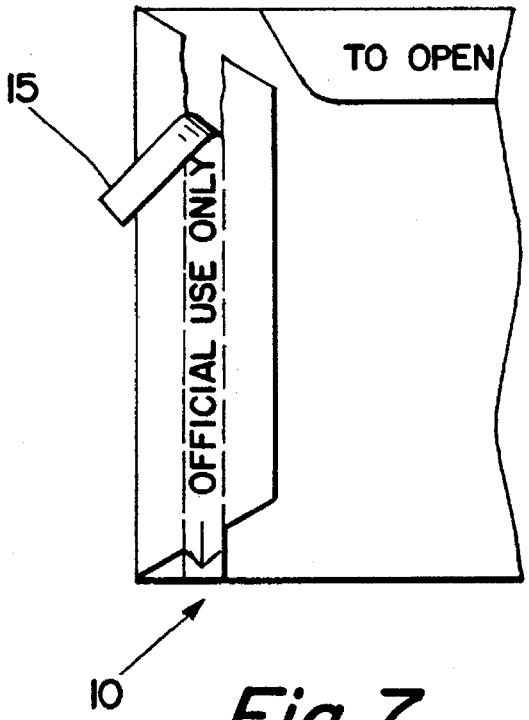
FIG. 7 is a rear view of the envelope with an official tab being opened by the sender after being returned by the recipient.

In FIG. 7, the envelope 10 has been received by the sender, who then peels the official tab 15 to re-open the envelope.

Figure 8:
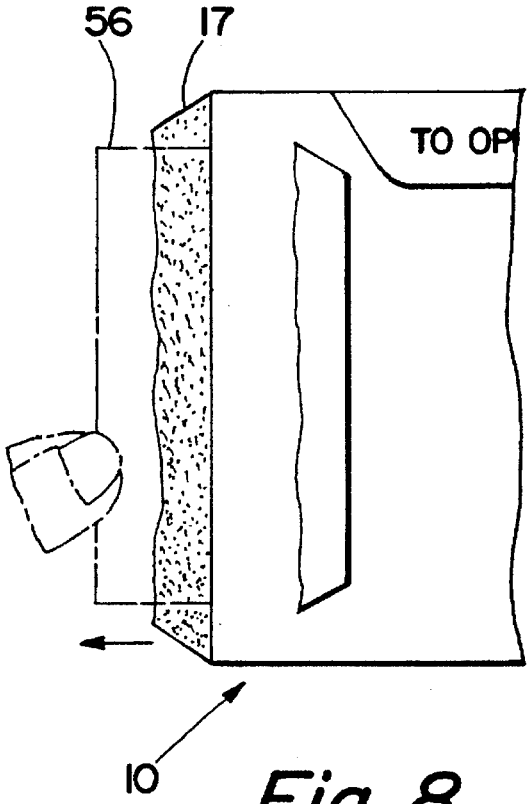
FIG. 8 is a rear view of the envelope, with the official tab completely removed, and payment being removed by the sender.

Referring to FIG. 8, the payment 56 may then be removed by the sender at the official flap 17.

In conclusion, herein is presented a self-reply envelope system, that allows dual correspondence between a sender and a recipient using a single envelope.

What is claimed is:

1. A self-reply envelope, comprising:

a front panel having a front panel top, a front panel bottom, a front panel left, and a front panel right;

sender address indicia, located on the front panel;

return mail indicia, located on the front panel left and extending between the front panel bottom and front panel top;

a sender arrow adjacent to the return mail indicia which refers to the sender indicia;

a rear panel, the rear panel has a rear panel left and a rear panel right, the front panel attached to the rear panel creating a pocket therebetween, the front panel and rear panel are comprised of a single piece of material, and are connected by a main fold at the front panel bottom; and a main flap attached to the rear panel right, the main flap attachable to the front panel left to seal the envelope, the main flap comprising:

an inner flap, an outer flap, the inner flap and outer flap have gummed portions to seal the main flap to the front panel; and an opening tab, located between the inner flap and outer flap, having a pair of perforated edges separating the opening tab from the inner flap and outer flap, the opening tab removable from the inner flap and outer flap at said perforated edges, the opening tab covering the return mail indicia when the main flap is attached to the front panel, the opening tab removable to reveal the return mail indicia wherein the main flap extends from the rear panel right and is sealable to the front panel left, the front panel further comprises an official panel extending from the front panel right, the official panel is sealable to the rear panel left, the official panel having an official tab having official tab indicia which indicates that the official panel is for official use only, the front panel top having a top flap, which is sealable to the rear panel.

2. The apparatus as recited in claim 1, wherein the front panel has an upper right and a lower left, the front panel further comprising standard stamp indicia located at the upper right, and return stamp indicia located at the lower left.

3. The apparatus as recited in claim 2, wherein the front panel further comprises instructional indicia having a first instructional arrow, which points toward the return stamp indicia, and a second instructional arrow, which points toward the front panel left.

4. The apparatus as recited in claim 3, wherein the inner flap has an inner flap width which corresponds to the distance between the rear panel right and the opening tab, the return mail indicia is located a distance from the front panel left corresponding to the inner flap width.

5. The apparatus as recited in claim 4, wherein the sender address indicia is located at the upper left, and further comprising recipient indicia on the front panel.

* * * * *